United States Patent [19]

Bauer et al.

[11] 4,304,343

[45] Dec. 8, 1981

[54] HYDRAULIC NOSE TILT POURING DEVICE

[75] Inventors: Gerd F. Bauer, Waldo; Donald Savatski, Port Washington, both of Wis.

[73] Assignee: Modern Equipment Company, Port Washington, Wis.

[21] Appl. No.: 88,861

[22] Filed: Oct. 29, 1979

[51] Int. Cl.[3] ..... B22D 41/04

[52] U.S. Cl. ..... 222/604

[58] Field of Search ..... 212/130; 414/639; 222/604, 605, 166

[56] References Cited

U.S. PATENT DOCUMENTS

| | | | |
|---|---|---|---|
| 564,770 | 7/1896 | Aiken | 222/604 X |
| 2,463,811 | 3/1949 | Schulze | 222/604 |
| 2,637,883 | 5/1953 | Schulze | 222/604 X |
| 3,277,539 | 10/1966 | Haberlin | 212/130 X |

FOREIGN PATENT DOCUMENTS

| | | | |
|---|---|---|---|
| 712067 | 7/1966 | Italy | 222/604 |
| 792133 | 3/1958 | United Kingdom | 222/604 |

OTHER PUBLICATIONS

Modern Equipment Company, "Fluid Powered Pouring Device", Feb. 1973.

*Primary Examiner*—David A. Scherbel

[57] ABSTRACT

A suspension frame for supporting a nose-tilt molten metal ladle includes end-to-end vertically arranged hydraulic cylinders above the ladle and totally protected within an elongated hollow enclosure. One of these cylinders is connected to an overhead carriage and operates to raise the suspension frame and the ladle as a unit. The other cylinder is connected to the ladle such that it raises the ladle relative to the suspension frame, causing the ladle to tilt about a pivotal connection at the ladle spout. The pouring device is completely self-contained with the hydraulic fluid reservoir, the hydraulic pump and motor, and a rechargeable electric storage battery for powering the pump motor all being supported on the suspension frame. Adjustment is provided to permit selection of the basic vertical position of the ladle within the suspension frame.

5 Claims, 4 Drawing Figures

HYDRAULIC NOSE TILT POURING DEVICE

BACKGROUND OF THE INVENTION

The invention relates to molten metal ladles and, more particularly, to an arrangement for pouring molten metal from a nose tilt type ladle.

Nose tilt type ladles for pouring molten metal and the advantages to be gained from such apparatus are well known. It has also been known to use various types of power sources, electric motors or hydraulic cylinders, for manipulating the ladle. An example of such devices can be found in U.S. Pat. No. 3,277,539.

An object of this invention is to provide a more efficient and effective suspension and tilting arrangement for a nose tilt ladle.

Further objects are to provide such an arrangement which has enhanced mobility because it is completely self-contained and which is well suited to effective operations in a foundry environment because its operative elements are protected from direct exposure to heat and airborne contaminants normally associated with a foundry pouring operation.

Yet another, more specific object is to provide for enhanced adjustability as to the basic position of the ladle in the suspension frame.

For the achievement of these and other objects, this invention contemplates a suspension frame for a ladle which includes a first pivot connection at the ladle point and a second pivot connection to the ladle at a point spaced from the first mentioned pivot connection. The ladle and its suspension frame are adapted to be mounted on and suspended from a conventional crane or trolley runway. Hydraulic cylinder means is provided in the suspension frame and has a first operative portion which is effective when energized to raise the suspension frame and ladle as a unit. A second operative portion of the hydraulic cylinder means is connected to the ladle and is effective when it is energized to produce a lifting force on the ladle tending to raise the ladle relative to the suspension frame, this force causes the ladle to tilt on the pivot connection adjacent its spout and the degree of tilting controls the flow of molten metal from the ladle.

Preferably a hydraulic fluid reservoir, hydraulic pump means and an electric storage battery pack, together with the necessary hydraulic conduits and valving, are all supported on the suspension frame so that the entire device is self-contained. Accordingly, the device can be moved on the runway as a unit without regard to external power or control lines.

Furthermore, in a specific preferred arrangement, the suspension frame contains adjustment to permit selection of the basic, transport position of the ladle.

DESCRIPTION OF PREFERRED EMBODIMENT

Other objects and advantages will be pointed out in, be apparent from, the specifications and claims, as will obvious modifications of the embodiment shown in the drawings, in which:

Figure 1:
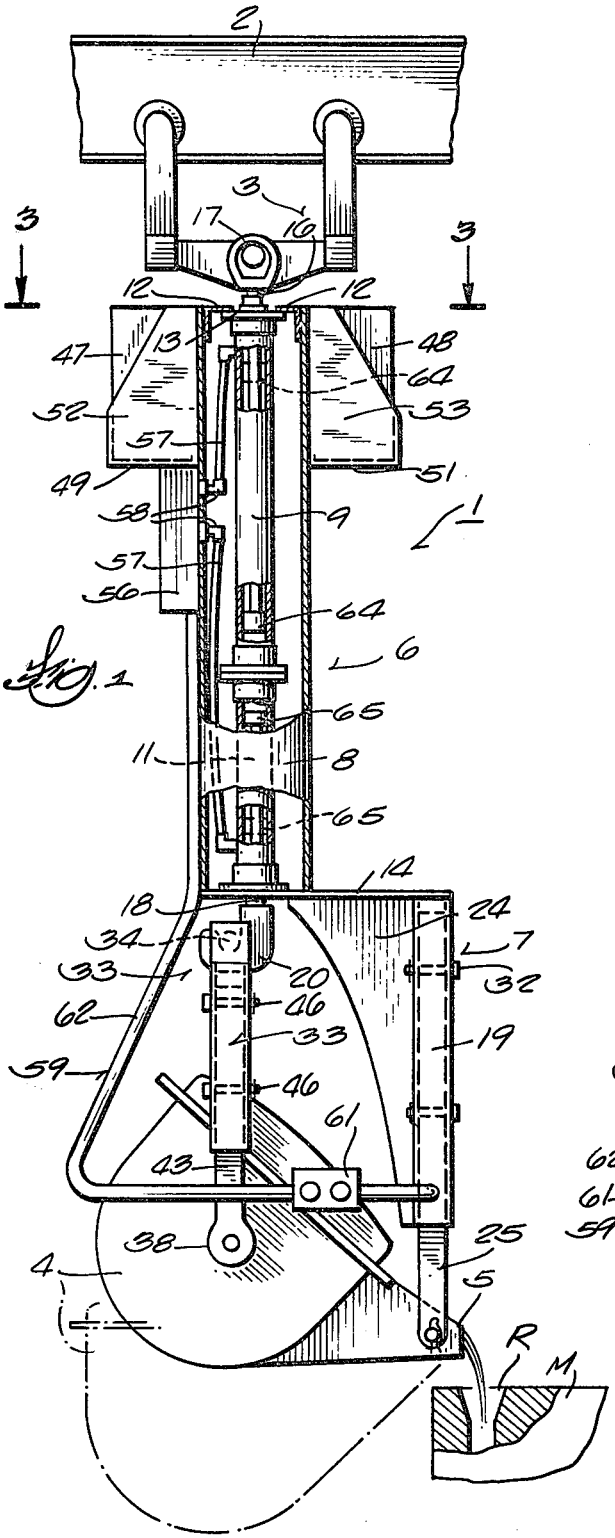
FIG. 1 is a side elevation of a pouring device incorporating this invention and illustrating the ladle in both transport (dotted lines) and pouring (full lines) positions.
Figure 2:
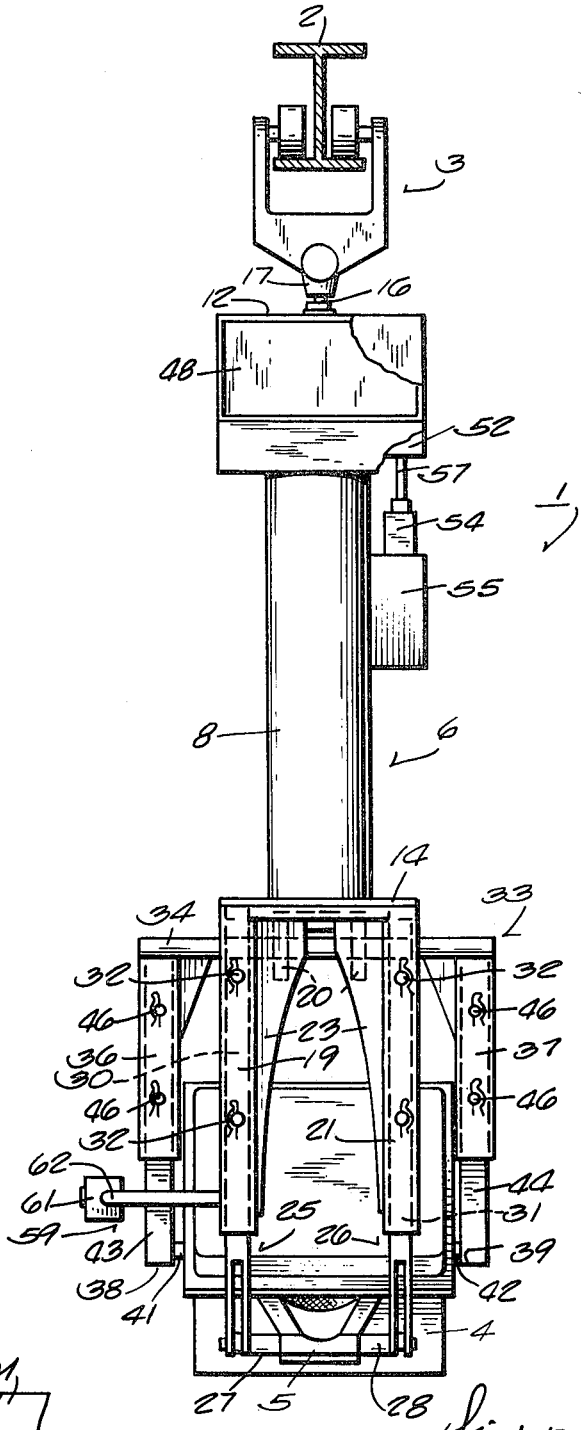
FIG. 2 is an end view of the pouring device of FIG. 1.
Figure 3:
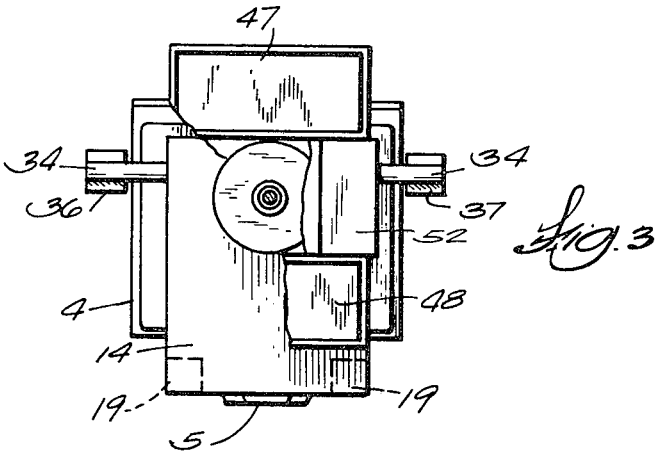
FIG. 3 is a section view taken generally along line 3—3 of FIG. 1.
Figure 4:
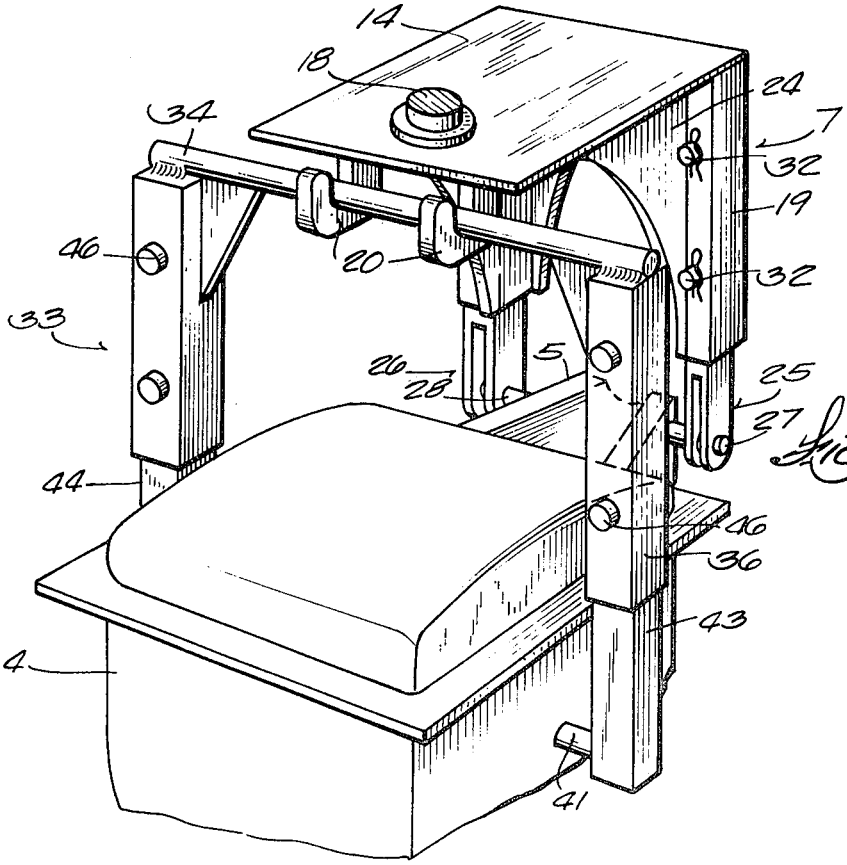
FIG. 4 is a perspective view of a portion of the pouring device of FIG. 1 illustrating the connection of the ladle in the suspension frame.

With particular reference to FIG. 1, a pouring device 1 is illustrated as being suspended from a conventional crane runway 2 on a trolley 3. The runway and trolley, and the connection therebetween, are conventional.

The pouring device includes a ladle 4 and a suspension frame which is made up of an operating section 6 and a ladle subframe 7. The operating section 6 is built on a basic hollow elongated enclosure 8, this enclosure can be circular or rectangular in cross-section as desired. Two separate, i.e. independently operable, hydraulic cylinders 9 and 11 are housed within enclosure 8. Preferably, the cylinders are aligned vertically and connected end-to-end.

The upper end of the enclosure 8 is closed by brackets 12 and the flanged end 13 of cylinder 9. The lower end of the enclosure is closed by plate 14, which is also part of the subframe 7. With this arrangement, and as will appear more completely from the description to follow, the basic operating elements, the hydraulic cylinders, are totally enclosed affording protection from the environment in which the pouring device is intended to operate. Enclosure 8 specifically provides a heat shield for the cylinders, protecting them from radiant heat usually associated with a pouring operation.

Ram 16 of hydraulic cylinder 9 projects upwardly from the upper end of enclosure 8. The free end of ram 16 carries a turnbuckle type connector 17 for making the actual attachment of the device to carriage 3 as is shown. Connector 17 fits over a rod supported in carriage 3. In this way, the overall device can be moved on carriage 3 to any selected position along a mold line. Moreover, the connection of ram 16 to connect on 17 is rotatable so that the entire device can be rotated to orient the ladle in a horizontal plane for pouring.

Subframe 7 includes arms 19 and 21 which depend from plate 14. The plate is in a generally horizontal plane and the arms are generally vertical. Reinforcement for arms 19 and 21 and plate 14 is provided by (1) a brace 25 attached to the underside of plate 14 and to arms 19 and 21, (2) plates 23 extending across the front of the subframe and attached to brace 25, plate 14 and arms 19 and 21, and (3) plates 24 extending rearwardly in the subframe and connected to plate 14 and respective ones of arms 19 and 21. This basic structure provides not only vertical support but also front-to-rear and lateral stability for the subframe and correspondingly the ladle.

The lower end of each of the arms 19 and 21 is provided with a form of clevis type connector 25 and 26 each of which is positioned over a stub shaft 27 and 28 fixed to and extending from opposite sides of spout 5. The clevis members and stubshafts are held in position by a cotter pin type connector. Removal of the cotter pins releases the pivot connection to in turn release the ladle for removal from the suspension frame for either maintenance or replacement.

Stubshafts 27 and 28 are located on opposite sides of spout 5. The point of connection between arms 19 and 21 and stubshafts 27 and 28 is adjacent to spout 5, specifically adjacent the pouring lip of the spout. Accordingly, little, or no, deviation in vertical height of the lip of the spout will occur during pouring.

In the preferred embodiment, clevis connectors 26 and 26 are connected to the ends of elongated arms 30 and 31 which telescope within arms 19 and 21. Arms 19, 30 and 21, 31 are each provided with a series of vertically spaced holes. The arms can be moved relative to each other to vary the vertical extensions of arms 30 and 31 beyond arms 19 and 21. Insertion of lock pins 32 through aligned holes in arms 19, 30 and 21, 31 hold the arms in a selected, adjusted position.

A ladle yoke 33 has an upper horizontal bar 34, which rests in the recess of hook 20. Two vertical arms 36 and 37 depend from the opposite ends of bar 34 and carry trunnions 38 and 39. The trunnions fit over stubshafts 41 and 42 fixed to ladle 4 and form a pivotal connection between yoke 33 and the ladle. Stubshafts 41 and 42 are aligned on a common axis and that axis is located on the center of the mass of the ladle to minimize the lifting forces required during pouring. Similar to arms 19 and 21, arms 36 and 37 have telescoping lower arm portions 43 and 44. These arms contain a series of vertically spaced holes and lock pins 46 are used to lock the arms in a selected, adjusted position.

A battery pack is located adjacent the upper end of enclosure 8. The battery pack consists of two electric storage batteries 47 and 48 which are positioned on L-shaped platforms 49 and 51. Side plates 52 and 53 complete the support platforms for the batteries.

The hydraulic system for the activating cylinders 9 and 11 includes a hydraulic fluid reservoir 52 and a motor-pump combination 55 both connected to and supported from enclosure 8. Valves 54 and 56, conduits 57 and fittings 58 complete a conventional hydraulic circuit. Since the hydraulic components and circuit are conventional, they have not been illustrated, nor will they be described, in detail.

An operator control arm 59 extends laterally from one side of the device and carries control box 61. The control box is connected by conventional circuitry (not shown) which extends through conduit 62 to the electrical source 47–48, valves 54 and 56, and to pump-motor 53 to provide for selective actuation of cylinders 9 and 11.

Hydraulic cylinders are illustrated as single acting so that operation to achieve their respective lifting function is achieved by pressurizing the cylinder, lowering then being accomplished by relieving the pressure and relying upon gravity.

More particularly, cylinder 9 is illustrated pressurized and with the pouring device in its uppermost position relative to trolley 3. In this position ram 16 is fully retracted within the cylinder and piston end 64 is near the bottom of the cylinder. When the pressure in the cylinder is relieved the weight of the pouring device will produce downward motion thereof until ram 16 is fully withdrawn from cylinder 9 and piston end 64 is adjacent the top of the cylinder (the dotted line showing in FIG. 1).

Cylinder 11 is also illustrated pressurized and with ladle 4 in its uppermost pouring position relative to mold M. In this position ram 18 is fully retracted within cylinder 11 and piston end 65 is near the top of the cylinder. When pressure is relieved from the cylinder the weight of ladle 4 will produce downward pivotal movement thereof about pins 27 and 28 until ram 18 is fully extended from cylinder 11 and piston end 65 is located near the bottom of the cylinder (the dotted line showing in FIG. 1).

In operation, an operator grasps control arm 59 and moves the entire pouring device horizontally on runway 2 to a filling position at which it can receive molton metal. At this time cylinder 11 is not pressurized so that the ladle is generally horizontal and cylinder 9 is used to position the ladle at the proper height for filling.

When filled, the operator moves the pouring device horizontally along the runway to a desired position along a mold line which may contain a number of molds M. Cylinder 9 is used to position the ladle at the desired height for pouring, and the pouring device is rotated about turnbuckle 17 to orient the spout relative to the runner R of the mold.

When properly positioned cylinder 11 is selectively pressurized to achieve a controlled pour of molten metal in mold M. More particularly, the lifting force of cylinder 11 is transmitted to ladle 4 through stubshaft 41 and 42 causing the stubshafts to move upwardly relative to pins 27 and 28 thereby tilting the ladle.

Although single acting cylinders have been illustrated and gravity is used to achieve the lowering action of the pouring device and the ladle, double acting cylinders could also be utilized so that hydraulic pressure is used to raise and lower the suspension frame and also to tilt and level the ladle. The single acting cylinder arrangement using gravity to lower the associated units is preferred as it reduces the electrical demand in the system.

Although but one embodiment of the present invention has been illustrated and described, it will be apparent to those skilled in the art that various changes and modifications can be made therein without departing from the spirit of the invention or from the scope of the appended claims.

We claim:

1. Apparatus for manipulating a nose-tilt molten metal ladle or the like comprising, in combination, a ladle having a pouring spout, a suspension frame including first pivot means connected to said ladle adjacent said spout and second pivot means connected to said ladle at a point spaced from said first pivot means, hydraulic cylinder means connected in said suspension frame and having a first operative portion effective when energized to raise said suspension frame and said ladle as a unit, said hydraulic cylinder means also including a second operative portion connected to said ladle through said second pivot means and effective when energized to raise said second pivot means relative to said first pivot means wherein molten metal contained in said ladle can be poured from said spout, a reservoir for hydraulic fluid connected to and supported on said suspension frame, hydraulic pump means supported on said suspension frame, hydraulic circuit means operatively connecting said reservoir, said pump means and said hydraulic cylinder means for relative operation of said first and second operative portions, electric storage battery means connected to and supported on said suspension frame and operatively connected to said pump means for supplying electric power to said pump means, said suspension frame including an elongated vertically extending hollow enclosure positioned above said ladle, said hydraulic cylinder means being positioned within said enclosure, said reservoir, pump means and electric storage battery means being attached to said enclosure, said first operative portion of said hydraulic cylinder means including a first ram portion projecting upwardly from said suspension frame and providing a point of attachment from which said apparatus is suspended.

said second operative portion of said hydraulic cylinder means including a second ram portion projecting downwardly from said suspension frame toward said ladle, said first operative portion of said hydraulic cylinder means comprising a first hydraulic cylinder and said first ram portion and extending vertically within said enclosure, said second operative portion of said hydraulic cylinder means comprising a second hydraulic cylinder and said second ram portion, said second hydraulic cylinder being arranged end-to-end with said first hydraulic cylinder and extending vertically within said enclosure, means connecting said second ram portion to said second pivot means and including vertically adjustable members for selectively varying the vertical distance from said second ram to said second pivot means, and a sub-frame fixed relative to said ladle and including vertically adjustable members connected to said first pivot means for selectively varying the vertical position of said first pivot means relative to said sub-frame.

2. The apparatus of claim 1 wherein said ladle has a center of mass and said second pivot means is positioned generally at said center of mass.

3. Apparatus for manipulating a nose-tilt molten metal ladle or the like comprising, in combination, a ladle having a pouring spout projecting laterally therefrom, a suspension frame including an elongated vertically extending hollow enclosure positioned above said ladle and a sub-frame fixed relative to said elongated enclosure and having a horizontal portion projecting laterally relative to said enclosure and spaced vertical portions depending from said horizontal portion toward and positioned on opposite sides of and adjacent to said pouring spout, first pivot means adjacent said spout and attaching said vertical portions to said ladle for pivotal movement of said ladle about said first pivot means located adjacent said spout, first and second hydraulic cylinders fixedly positioned within said enclosure being relatively vertically aligned and arranged end-to-end and each including a ram end, the ram end of one cylinder projecting upwardly from said enclosure to provide a point of attachment from which said apparatus is suspended and so that said one cylinder is operative to raise said apparatus and ladle as a unit, the ram end of the other cylinder projecting downwardly from said enclosure toward said ladle, second pivot means attaching the ram end of the other cylinder to said ladle at a pivot spaced from said first pivot means so that said other cylinder is operative to raise said second pivot means relative to said first pivot so that said ladle tilts on said first pivot means to pour molten metal contained therein from said spout, a reservoir for hydraulic fluid connected to and supported on said suspension frame, hydraulic pump means supported on said suspension frame, hydraulic circuit means operatively connecting said reservoir, said pump means and said hydraulic cylinders, for selective operation of said first and second hydraulic cylinders, electric storage battery means connected to and supported on said suspension frame and operatively connected to said pump means for supplying electric power to said pump means, means connecting said second ram portion to said second pivot means and including vertically adjustable members for selectively varying the vertical distance from said second ram to said second pivot means, and said sub-frame being fixed relative to said ladle and including vertically adjustable members connected to said first pivot means for selectively varying the vertical position of said first pivot means relative to said sub-frame.

4. Apparatus for manipulating a nose-tilt molten metal ladle or the like comprising, in combination, a ladle having a pouring spout, a suspension frame including first pivot means connected to said ladle adjacent said spout and second pivot means connected to said ladle at a point spaced from said first pivot means, said suspension frame including an elongated vertically extending hollow enclosure positioned above said ladle, hydraulic cylinder means housed within said enclosure and connected to said suspension frame, said hydraulic cylinder means including a first operative portion effective when energized to raise said suspension frame and said ladle as a unit, said hydraulic cylinder means also including a second operative portion connected to said ladle through said second pivot means and effective when energized to raise said second pivot means relative to said first pivot means so that said ladle tilts on said first pivot means and molten metal contained in said ladle can be poured from said spout, said first operative portion of said hydraulic cylinder means including a first ram portion projecting upwardly from said suspension frame and providing a point of attachment from which said apparatus is suspended, said second operative portion of said hydraulic cylinder means including a second ram portion projecting downwardly from said suspension frame toward said ladle, said first operative portion of said hydraulic cylinder means comprising a first hydraulic cylinder and said first ram portion and extending vertically within said enclosure, said second operative portion of said hydraulic cylinder means comprising a second hydraulic cylinder and said second ram portion, said second hydraulic cylinder arranged end-to-end with said first hydraulic cylinder and extending vertically within said enclosure, and means connecting said second ram portion to said second pivot means and including vertically adjustable members for selectively varying the vertical distance from said second ram to said second pivot means, and a sub-frame fixed relative to said ladle and including vertically adjustable members connected to said first pivot means for selectively varying the vertical position of said first pivot means relative to said sub-frame.

5. The apparatus of claim 4 wherein said ladle has a center of mass and said second pivot means is positioned generally at said center of mass.

* * * * *